United States Patent [19]

Scholz

[11] Patent Number: 4,991,288

[45] Date of Patent: Feb. 12, 1991

[54] METHOD OF TERMINATING AN ELECTRICAL CONDUCTOR WIRE

[75] Inventor: James P. Scholz, New Cumberland, Pa.

[73] Assignee: AMP Incorporated, Harrisburg, Pa.

[21] Appl. No.: 415,164

[22] Filed: Sep. 29, 1989

[51] Int. Cl.[5] ..... H01R 43/02

[52] U.S. Cl. ..... 29/854; 29/447; 29/860; 29/859

[58] Field of Search ..... 174/DIG. 8, 88 R, 84 R, 174/35 C, 36, 88 C; 29/860, 863, 857, 854, 447; 264/230

[56] References Cited

U.S. PATENT DOCUMENTS

| | | | |
|---|---|---|---|
| 2,759,161 | 8/1956 | Berg | 339/97 |
| 2,926,231 | 2/1960 | McDowell | 219/9.5 |
| 3,491,426 | 1/1970 | Grassauer | 29/203 |
| 3,525,799 | 8/1970 | Ellis | 174/84 |
| 3,601,783 | 8/1971 | Loose | 339/223 R |
| 3,708,611 | 1/1973 | Dinger | 174/84 C |
| 3,945,114 | 3/1976 | Siden et al. | 29/628 |
| 4,256,945 | 3/1981 | Carter et al. | 219/10.75 |
| 4,341,921 | 7/1982 | Simpson | 174/84 R |
| 4,595,724 | 6/1986 | Koblitz | 524/409 |
| 4,623,401 | 11/1986 | Derbyshire | 148/13 |
| 4,626,767 | 12/1986 | Clappier et al. | 323/280 |
| 4,659,912 | 4/1987 | Derbyshire | 219/535 |
| 4,852,252 | 8/1989 | Ayer | 29/860 |

FOREIGN PATENT DOCUMENTS 0241597 10/1987 European Pat. Off. .

OTHER PUBLICATIONS

U.S. patent application Ser. No. 071/375,787, Scholz (abstract enclosed).

U.S. patent application Ser. No. 07/385,643, Ayer et al. (abstract enclosed).

U.S. patent application Ser. No. 07/287,766, Beinhaur et al. (abstract enclosed).

U.S. patent application Ser. No. 07/277,095, Henschen et al. (abstract enclosed).

U.S. patent application Ser. No. 07/277,116, Henschen et al. (abstract enclosed).

U.S. patent application Ser. No. 07/277,170, Henschen et al. (abstract enclosed).

U.S. patent application Ser. No. 07/277,361, Henschen et al. (abstract enclosed).

U.S. patent application Ser. No. 07/277,362, henschen et al. (abstract enclosed).

*Primary Examiner*—Joseph M. Gorski

*Attorney, Agent, or Firm*—Anton P. Ness

[57] ABSTRACT

A band of bipartite metal foil is crimped around a portion of a stripped wire end near the insulation and spaced from the portion to be soldered to a terminal solder tail extending from a housing portion, with a first layer of conductive nonmagnetic metal and a thin second layer of high resistance metal having high magnetic permeability. When the wire end is paired with the solder tail with a solder preform placed therearound within a length of heat recoverable tubing extending between the insulated wire portion and the housing of the terminal, and high frequency alternating current is induced in the bipartite metal foil, thermal energy is generated which is conducted along the wire end and radiates outwardly to melt the solder to join the wire end to the solder tail, and to shrink the tubing to grip the insulated wire portion and housing portion to cover and seal the termination thus formed. A pair of wires can be similarly be spliced and sealed, with a bipartite metal foil band crimped around one of the wire ends able to generate thermal energy to melt a solder preform when appropriate current is induced therein.

4 Claims, 5 Drawing Sheets

METHOD OF TERMINATING AN ELECTRICAL CONDUCTOR WIRE

FIELD OF THE INVENTION

The present invention relates to the field of electrical connectors and more particularly to a termination of a pair of electrical conductors.

BACKGROUND OF THE INVENTION

Electrical connectors are known which have a plurality of terminals disposed in a dielectric housing and which are to be terminated to a respective plurality of conductor wires, and the housing then secured within a protective shell. In one such connector the terminals are disposed in a single row within a wafer-like dielectric housing or module and extend rearwardly from the housing, to conclude in termination sections comprising shallow channels termed solder tails. The housing may include cylindrical portions extending rearwardly to surround the terminals forwardly of the solder tails. When the conductor wires are prepared to be terminated to the solder tails, individual sleeve-like solder preforms encased within respective longer sleeves of heat recoverable or heat shrink tubing are placed over the rearwardly extending terminal portions so that the solder preforms surround the solder tails, or a strip of such units appropriately spaced apart; the stripped wire ends are then inserted into the heat recoverable tubing sleeves and into the solder preforms surrounding the solder tails. The connector assembly is then heated to an elevated temperature such as by being placed in a conventional convection oven or by a stream of hot air directed at the tubing sleeves.

The heat energy penetrates through the heat recoverable tubing to melt the solder which then flows around the stripped wire ends within the solder tails and upon cooling forms respective solder joints joining the conductor wires to the terminals; and simultaneously the heat recoverable tubing is heated above a threshold temperature at which the tubing shrinks in diameter until it lies adjacent and tightly against surfaces of the solder tails and the wire termination therewithin, against a portion of the insulated conductor wire extending rearwardly therefrom, and against a portion of the terminal extending forwardly therefrom to the rearward housing surface covering the exposed metal surfaces. Apparatus for wire and sleeve handling with respect to such a connector is known such as from U.S. Pat. Nos. 3,945,114 and 3,491,426. Within forward and rearward ends of the tubing are located short sleeve-like preforms of fusible sealant material which will shrink and also tackify upon heating to bond and seal to the insulation of the wire, and to the cylindrical housing portions therewithin and to bond to the surrounding heat recoverable tubing; the termination is thus sealed.

Examples of such assemblies of heat recoverable tubing lengths with solder preforms and sealant preforms therein are disclosed in U.S Pat. Nos. 3,525,799; 4,341,921; 4,595,724 and 4,852,252. Similar assemblies and methods are disclosed in U.S. Pat. Applications Ser. No. 07/287,766 filed Dec. 21, 1988, Ser. No. 07/375,787 filed June 30, 1989, and Ser. No. 07/385,643 filed July 27, 1989 all assigned to the assignee hereof.

Another type of thermal energy generation is disclosed in U.S. Pat. No. 4,852,252 and in Ser. Nos. 07/287,766; 07/375,787 and 07/385,643: self-regulating temperature source technology is utilized wherein a bipartite metal foil is placed adjacent the termination site having the solder preform therearound, the foil having a first layer of low resistance nonmagnetic metal such as copper, and a second thin layer of high resistance metal having high magnetic permeability, such as a nickel/iron alloy, where the alloy has a property known as its Curie temperature. Such a bipartite metal foil will generate thermal energy when it has induced therein a constant amplitude high frequency alternating current such as radio frequency current which could be 13.56 MHz generated by an apparatus like that disclosed in U.S. Pat. No. 4,626,767; the heat will melt the solder and the sealant preforms and will shrink the tubing, simultaneously terminating the joint and sealing the termination; the temperature achieved in such a process will not exceed a certain known level, depending on the frequency and Curie temperature of the magnetic material used.

In Ser. No. 07/287,766 application of the requisite thermal energy to a pretermination assembly of a stripped wire end and a solder tail of a terminal both disposed inside a sleeve-like solder preform within a length of heat recoverable tubing, is accomplished by wrapping around the outside of the tubing a strip of foil having a layer of copper and a layer of nickel/iron alloy for example, and inducing a radio frequency current in the foil which then generates thermal energy; the thermal energy is transmitted to the tubing and the solder and sealant preforms, melting the solder to terminate the wire to the terminal and melting and tackifying the sealant preforms to bond to the insulated wire and terminal portions and shrinking the tubing. In one arrangement disclosed therein a plurality of terminations is performed simultaneously when a plurality of lengths of adjacent heat recoverable tubing around respective terminals and associated wire ends in a planar array is wrapped by a strip of foil which is then subjected to RF current such as by a coil of the RF current source or by electrodes of the source engaging ends of the foil, heating all the termination sites to the known temperature. In another disclosed arrangement, a single termination site has a strip of foil wrapped around the tubing, and the RF current is induced by a coil of the current source surrounding the foil.

It is desired to provide a means for soldering a single termination site in an array, enabling repair of a multi-terminal connector.

SUMMARY OF THE INVENTION

The present invention is a method for soldering the conductive portion of a first conductor means, such as a conductor wire, to the conductive portion of a second conductor means, such as a terminal of a connector. A heater preform is crimped onto an exposed portion of the stripped wire end adjacent the end of the insulation and spaced rearwardly from the end of the stripped wire end which is to be soldered to the terminal's solder tail. Crimping can be performed by known tools in use for crimping wire-receiving barrel sections of known terminals to wire ends. The heater preform is defined by a band of bipartite metal foil wrapped around the circumference of the stripped wire end, the foil having a first layer of low resistance nonmagnetic metal (such as copper) and a second layer of metal having high resistance and high magnetic permeability (such as Alloy No. 42 of nickel and iron).

Soldering is accomplished as follows: an apparatus is selected for generating constant amplitude high frequency alternating current such as radiofrequency (RF) current of 13.56 MHz and having a coil within which the pretermination assembly is placed, comprising at least the terminal solder tail and the stripped wire end both disposed within the solder preform and length of heat recoverable tubing; the apparatus is activated for a limited length of time such as thirty to sixty seconds, and the foil generates thermal energy and achieves a predetermined and known maximum temperature. The thermal energy produced is conducted along the wire to the termination site at the end thereof and radiates outwardly to melt the solder preform to form a solder joint between the wire end and terminal, and outwardly to and axially along the tubing length to melt the sealant preforms at the ends of the tubing and to shrink the tubing, thus defining a soldered sealed termination.

It is an objective of the present invention to provide a means for generating heat at a localized site for soldering a wire end to a terminal solder tail, in conjunction with a solder preform within a length of heat recoverable tubing.

It is also an objective to generate such thermal energy within a length of heat recoverable tubing.

It is a further objective that such means be easy to be utilized with known tools and apparatus.

An embodiment of the present invention will now be discussed with reference to the accompanying drawings.

DETAILED DESCRIPTION OF THE PREFERRED EMBODIMENT

Figure 1:
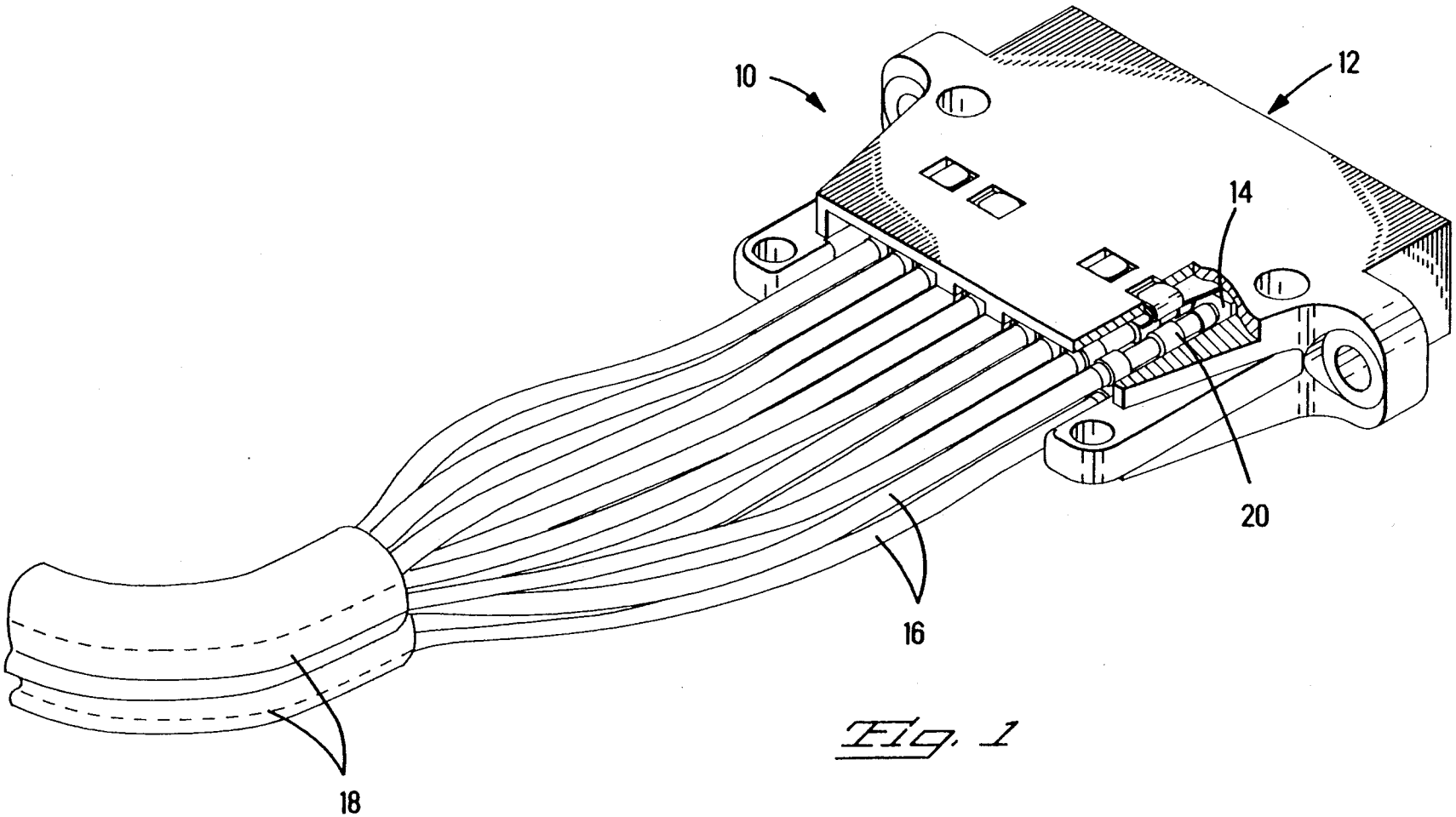
FIG. 1 is a perspective view of a connector with which the present invention may be used.
Figures 2, 3:
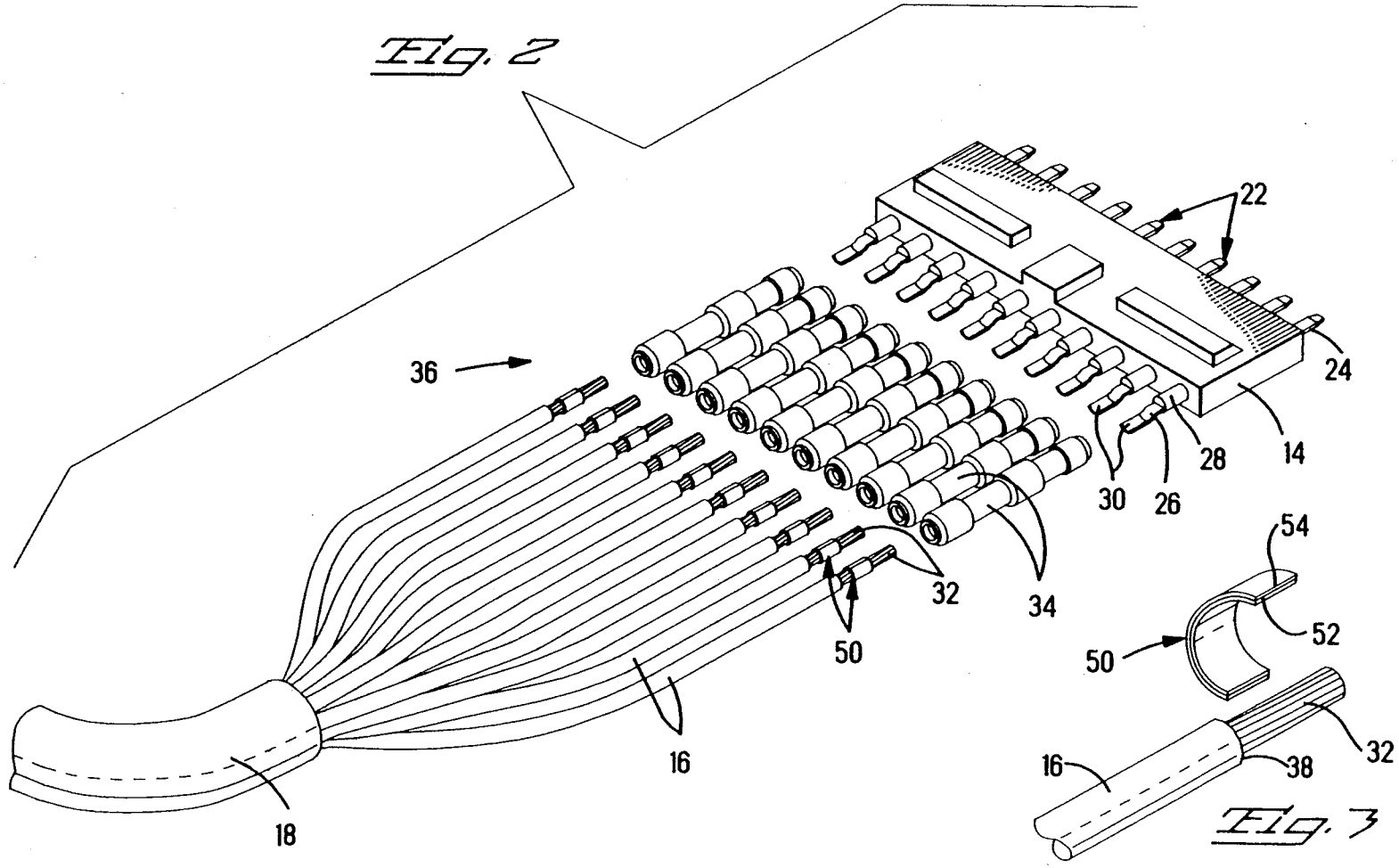
FIG. 2 shows a terminal subassembly of the connector of FIG. 1 exploded from the housing, with conductor wires exploded from the terminals and showing lengths of heat recoverable tubing containing solder preforms used in joining the wire ends to the terminal solder tails.
FIG. 3 is a perspective view of a band of heater foil being placed onto a stripped wire end to be crimped thereto in accordance with the present invention.

FIG. 1 shows a connector assembly 10 having a protective shell 12 within which a pair of terminal modules 14 are disposed, each of the modules including a plurality of terminals terminated to respective conductor wires 16 of a pair of cables 18 at sealed termination sites 20. FIG. 2 illustrates a terminal module 14 of dielectric material and the single row of terminals 22 disposed therewithin, having contact sections 24 extending forwardly of the module for eventual electrical connection with corresponding contact sections of a mating connector (not shown). Each terminal 22 includes an intermediate section 26 extending rearwardly from a cylindrical flange 28 of module 14 t o a shallow channel-shaped wire termination section termed a solder tail 30, to which a respective wire end 32 of a wire 16 is to be terminated by soldering. Sleeve assemblies 34 are assembled around each terminal solder tail and wire end, prior to soldering, to define a pretermination assembly 36, with each assembly 34 including a preform of solder therewithin.

FIG. 3 illustrates the method of the present invention. A heater preform 50 comprising a strip of bipartite metal foil is shown about to be wrapped around a stripped wire end 32 near the end of insulative jacket 38. After wrapping the heater preform 50 is crimped to the wire conductor to define a band, such as by a conventional crimping tool (not shown) used to crimp wire-receiving barrel sections of known terminals to stripped wire ends. The crimping deforms the heater preform 50 intimately against the wire conductor in a manner which necessarily permanently deforms the wire itself, establishing a good thermal connection therebetween. One such tool is disclosed in Military Specification No. M22520/2-01, and one such product is sold under Part No. 601966-1 by AMP Products Corporation of Valley Forge, Pa.

Heater preform 50 comprises a first layer 52 comprising a substrate of copper or copper alloy such as brass or phosphor bronze having a thickness of for example 0.002 inches. One major surface of the substrate has deposited thereon a thin second layer 54 of magnetic material such as a nickel-iron alloy like Alloy No. 42 having a thickness of for example between 0.0004 and 0.0006 inches. Typically a roll cladding process may be used where an amount of magnetic material is laid over the substrate, then subjected to high pressure and temperature which diffuses the two materials together at the boundary layer, but other processes such as plating or sputter depositing could be used. Optionally a heater preform could be formed by plating a layer of nickel onto a layer of copper to a thickness preferably 1-½ to 2 times the skin depth of nickel at the selected current frequency.

A thin layer of dielectric coating material may be applied over the magnetic material layer of the foil to become heater preform 50 to inhibit oxidation, and/or optionally a thin layer of solder resist may be used to coat the magnetic layer to inhibit flow of the molten solder along the wire end away from the termination site. A coating of inert polyimide resin would provide solder resist properties to the exposed surface of the magnetic material layer, such as KAPTON polyimide (trademark of E. I. duPont de Nemours and Company, Wilmington, Del.). A heater preform 50 can be made to have a total thickness of about 0.0024 to 0.0028 inches thick and thus be easily shaped to be crimped to the wire.

Figures 4, 5:
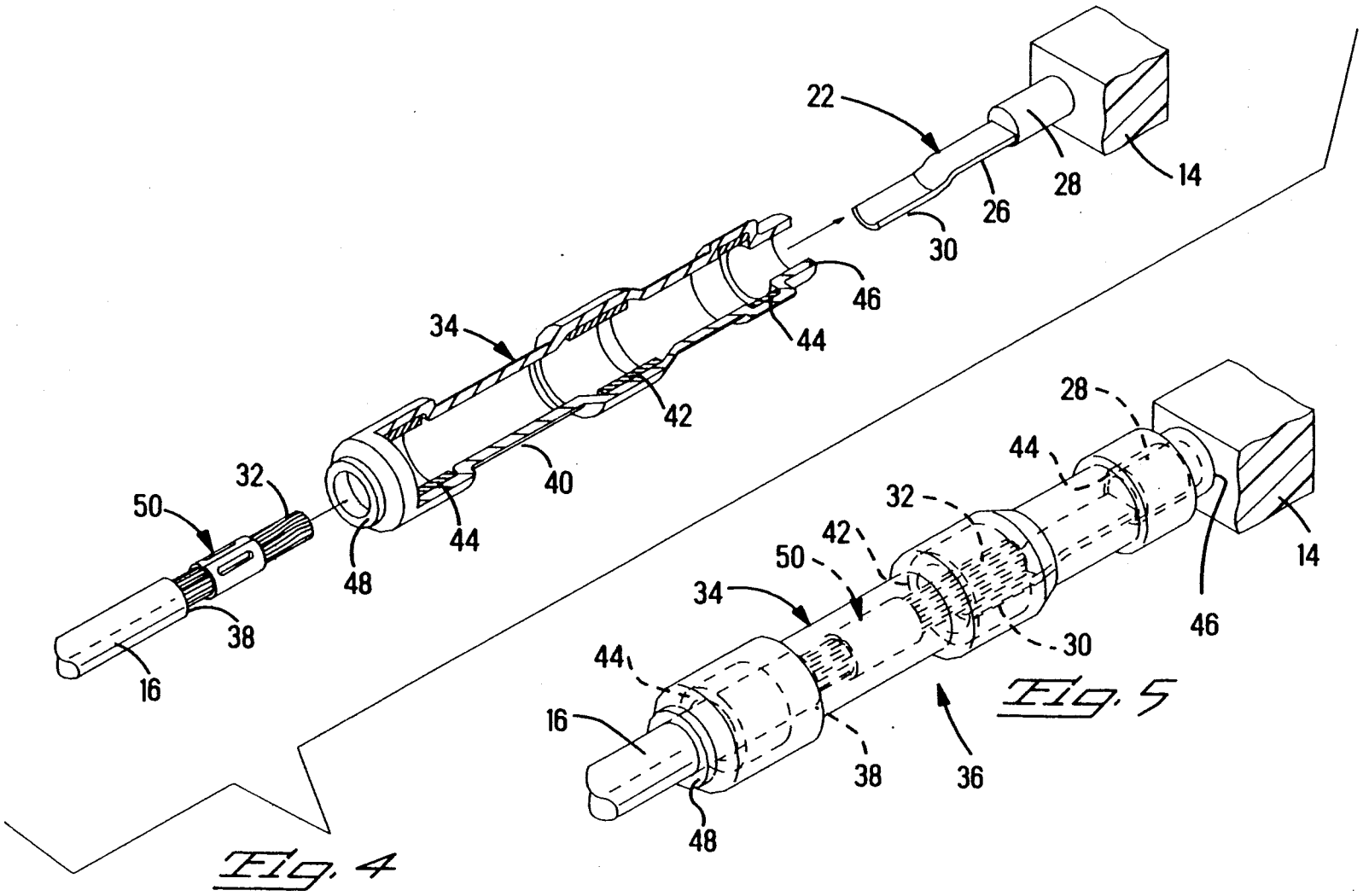
FIGS. 4 to 6 illustrate terminating a single wire end and terminal solder tail, with FIG. 4 showing a sleeve assembly in section and the wire end and terminal solder tail to be inserted thereinto, with FIG. 5 showing the pretermination assembly prior to heating, FIG. 6 showing a soldered and sealed termination.

In FIG. 4 a representative sleeve assembly 34 includes a length of heat recoverable tubing 40, a solder preform 42 having a sleeve shape of short length disposed centrally along and within tubing length 40, and sleeve-like sealant preforms 44 within tubing length 40 at respective ends 46, 48 thereof, axially spaced to be disposed over the end of a flange 28 and the insulative jacket end 38. Solder preform 42 may be of tin-lead solder including solder flux mixed therein or coated therearound, such as for example Sn-63 meltable at a temperature of about 183° C. or Sb-5 meltable at about 240° C.; sealant preforms 44 may comprise for example a homogeneous mixture of polyvinylidene fluoride, methacrylate polymer and antimony oxide, which will shrink in diameter at a nominal temperature selected to be about 190° C.; and tubing 40 is preferably transparent and may be cross-linked polyvinylidene fluoride and have a nominal shrinking temperature of about 175° C.

Generally it would be preferable to provide a thermal energy source capable of achieving a temperature of about 50° C. to 75° C. above the solder melting point, at the termination site. When assembled as seen in FIG. 5, leading end 46 of sleeve assembly 34 is placed over a respective solder tail 30 and moved forwardly until leading end 46 abuts the rear face of module 14, so that sealant preform 44 therewithin surrounds flange 28 and solder preform 42 surrounds solder tail 30. Optionally in a preliminary assembly step a limited amount of heat may then be applied locally to leading end 46 thereby reducing the sealant preform to bond to flange 28, and reducing tubing leading end 46 in diameter around flange 28 and reduced sealant preform 44. Stripped wire end 32 having heater preform 50 crimped therearound is inserted into trailing end 48 of sleeve assembly 34 until located such as by visual observation through transparent tubing 40 completely along solder tail 30 within solder preform 42 and insulative jacket end 38 is disposed within sealant preform 44 within trailing tubing end 48. Heater preform 50 is located on wire end 32 to be spaced rearwardly from solder preform 42 and solder tail 30.

Figure 6:
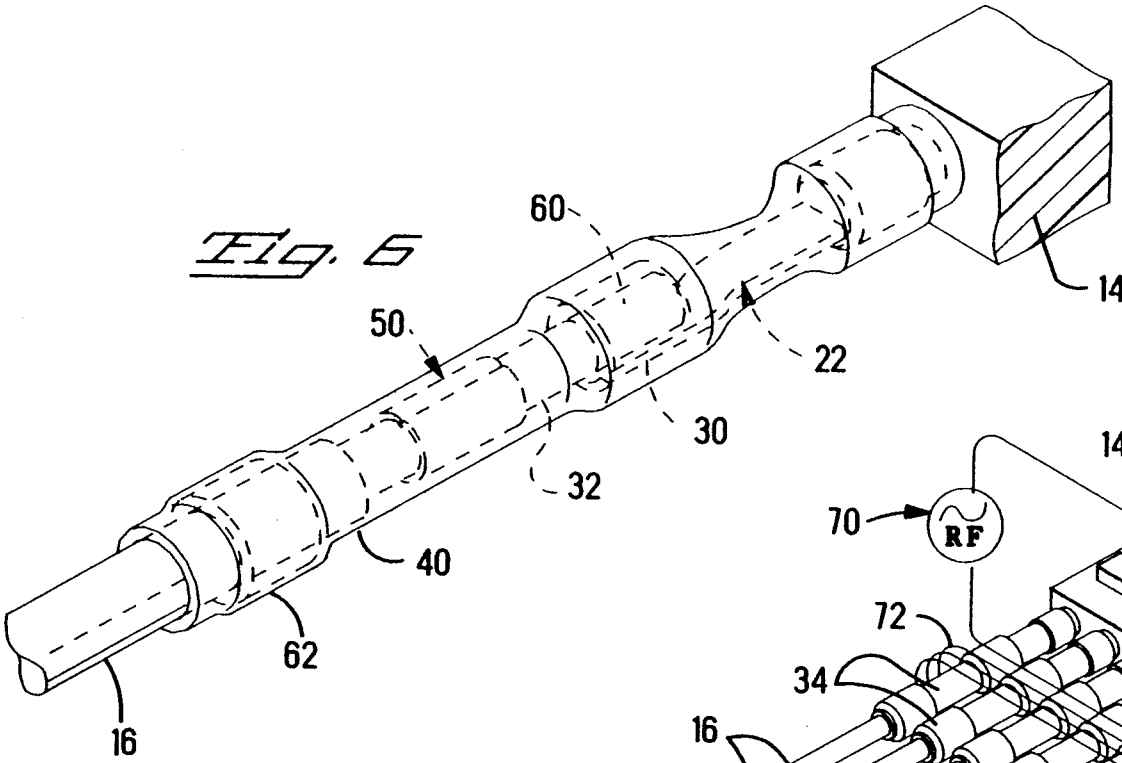

In FIG. 6 is seen a terminated and sealed connection 60, 62 after the solder has been melted according to the present invention with thermal energy generated by heater preform 50 to form a solder joint termination 60 between wire end 32 and solder tail 30, the sealant preform at leading end 46 has been shrunk in diameter to bond to flange 28 while the sealant preform 44 at trailing end 48 has been shrunk in diameter to bond to insulative jacket end 38, and tubing 40 has shrunk to conform to the outer surfaces of the structures therewithin, and bonds to the sealant preforms 44 thereby sealing the termination by tightly gripping about the insulative jacket end 38 at trailing end 48 and the flange 28 at leading end 46, forming a seal 62 extending between insulated conductor 16 and module 14.

Figure 7:
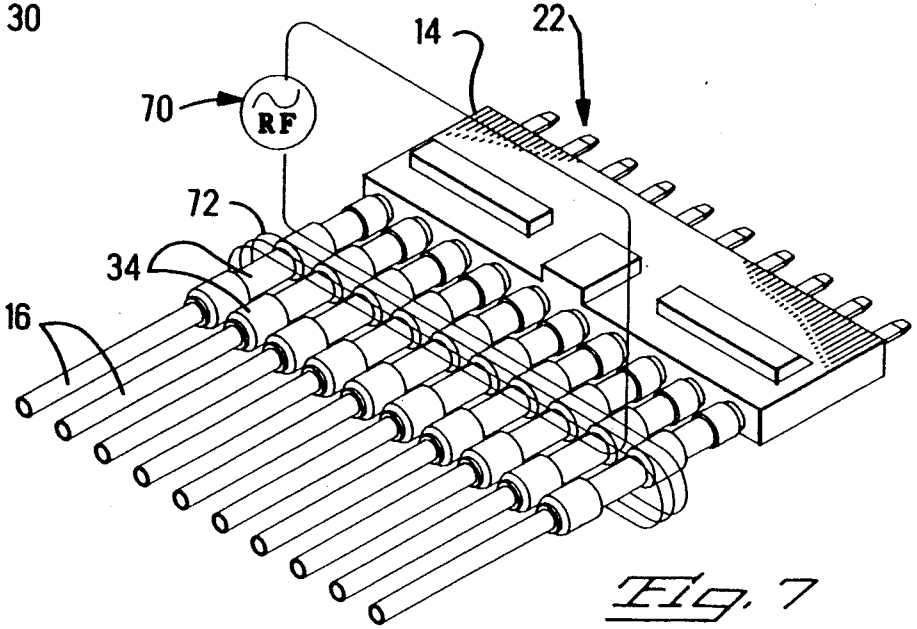
FIG. 7 is a diagrammatic illustration of an array of pretermination assemblies within a coil of an RF current source for the heaters crimped to the wire ends to be energized to produce thermal energy.

FIG. 7 illustrates the method of terminating ends of a plurality of wires 16 having heater preforms 50 thereon, to solder tails 30 of terminals 22 of module 14, and sealing the terminations. The terminal subassembly 36 and inserted wires have been placed and clamped within an apparatus 70 containing an inductance coil 72 closely surrounding the sleeve assemblies 34 in the termination region. A constant amplitude high frequency alternating current is generated by apparatus 70 such as a radio frequency signal at a frequency of 13.56 MHz such as by an apparatus disclosed in U.S. Pat. No. 4,626,767. After a length of time such as about 30 to 60 seconds, the heater preforms on the wire ends within the respective sleeve assemblies each have achieved a certain temperature determined by the particular magnetic material of the heater preforms, and the heat is conducted along the wire ends and radiates outwardly to melt the solder and permeates the tubing lengths melting the sealant preforms and shrinking the tubing, resulting in the soldered and sealed termination of FIG. 6.

Figure 8:
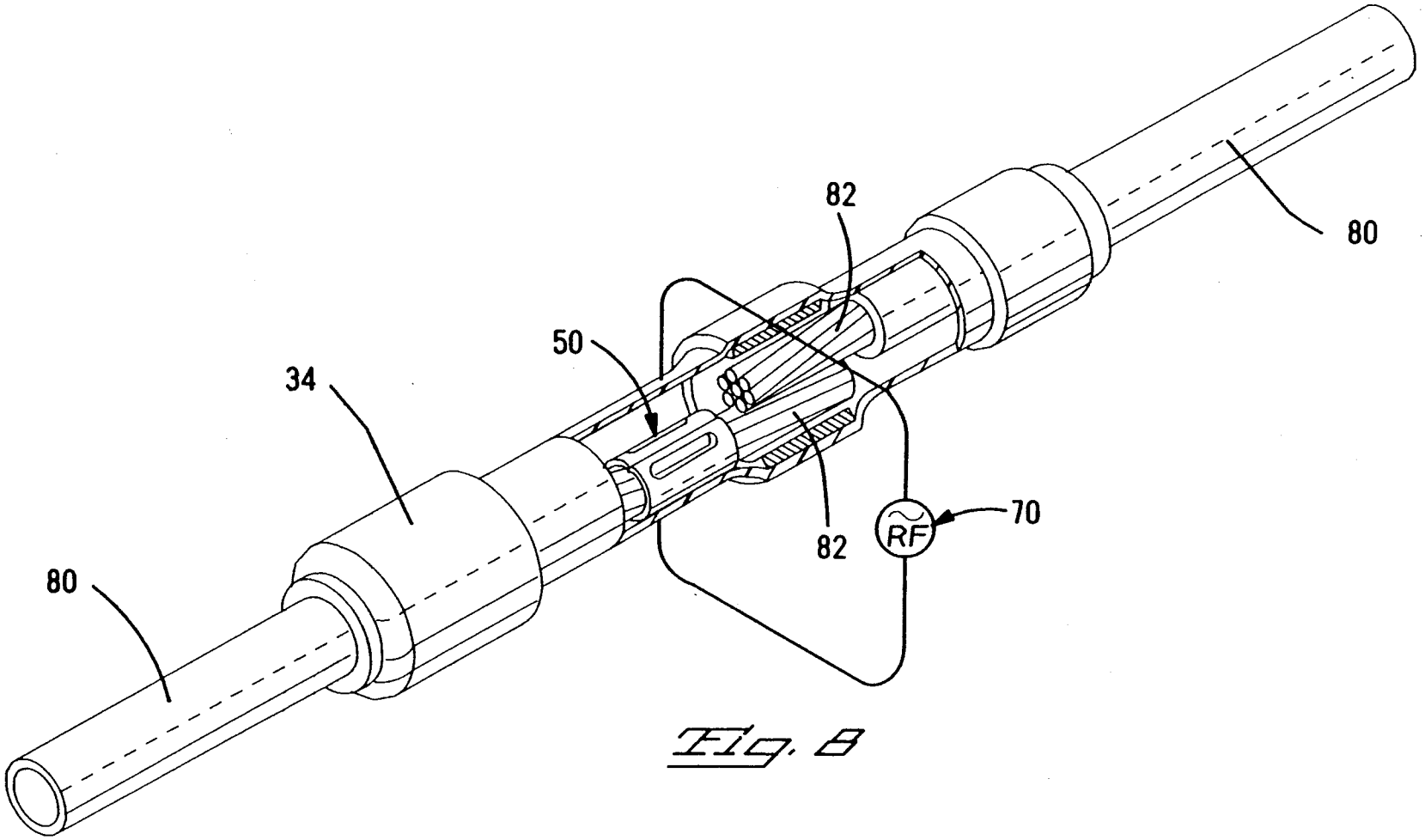
FIG. 8 shows two wires being spliced in accordance with the present invention.

FIG. 8 illustrates the method of the present invention used to splice a pair of wire ends 82 of conductor wires 80 to each other, using a sleeve assembly 34 having a solder preform 42 and sealant preforms 44 within a length of heat recoverable tubing 40. A heater preform 50 is crimped to one of the wire ends 82; when energized by a coil of an RF source the thermal energy produced by heater preform 50 will melt the solder preform, melt the sealant preforms and shrink the heat recoverable tubing length and define a sealed splice.

What is claimed is:

1. A method of joining first and second electrical conductor means, comprising the steps of:

providing a current source for generating a constant amplitude high frequency alternating current of known frequency;

preparing first and second termination sections of said first and second conductor means by exposing respective conductive portions thereof to be joined together and exposing an adjacent portion of said conductive portion of said conductor means spaced rearwardly from said first termination section;

forming a heater member having a length sufficient to extend around the circumference of said adjacent exposed portion, from a bimetallic heater means including a first layer of a first metal having low electrical resistance and minimal magnetic permeability and deposited on a major surface thereof a second layer of a second metal having a known Curie temperature, high electrical resistance and high magnetic permeability, said second layer having a thickness approximately equal to one skin depth of said second metal, given said known frequency;

wrapping said heater member around said adjacent exposed portion at a location spaced rearwardly from said first termination section and crimping said heater member to said adjacent exposed portion, thereby establishing an assured thermal connection therebetween;

selecting solder material having a nominal melting temperature slightly less than the Curie temperature of said second metal and selecting heat recoverable tubing of dielectric material having a nominal shrinking temperature slightly less than the Curie temperature of said second metal;

positioning said first and second termination sections together in paired, adjacent and coextending relationship, placing a preform of said solder material containing flux therefor at least adjacent said first and second termination sections, and placing a length of said heat recoverable tubing of sufficient diameter around said solder preform and said first and second termination sections, and enclosing said heater member and all exposed conductive portions of said first and second conductor means and at least insulated portions thereof with said tubing, thereby defining a pretermination assembly;

disposing said pretermination assembly within a coil of said current source and generating said constant amplitude high frequency alternating current in said heater member for a selected length of time, thereby generating a current in said heater member, and thereby generating thermal energy such that the Curie temperature of said second metal is achieved and maintained, transmitting the thermal energy to said solder preform, thereby melting said solder preform, and forming an assured joint between said first and second termination sections, and transmitting the thermal energy to said tubing, and thereby shrinking said tubing such that said tubing conforms to outwardly facing surfaces of said joined first and second termination sections and tightly engages the insulated portions of both conductor means, thereby covering and completely surrounding the joint and all exposed conductive portions and the heater member with said dielectric material.

2. The method as set forth in claim 1 wherein said first conductor means is a conductor wire.

3. The method as set forth in claim 2 wherein said conductive portion of said second conductor means is a terminal and said insulative portion of said second conductor means is a portion of a housing means.

4. The method as set forth in claim 2 wherein said second conductor means is a conductor wire.

* * * * *